US007412935B2

(12) United States Patent
Yip

(10) Patent No.: US 7,412,935 B2
(45) Date of Patent: Aug. 19, 2008

(54) METHOD OF PRODUCING FUNCTIONAL EMBELLISHED STITCHING AND THE PRODUCT THEREOF

(75) Inventor: Po Chu Yip, Hong Kong (CN)

(73) Assignee: Pac-Fung Feather Company Ltd., Hong Kong (CN)

( * ) Notice: Subject to any disclaimer, the term of this patent is extended or adjusted under 35 U.S.C. 154(b) by 166 days.

(21) Appl. No.: 11/285,837

(22) Filed: Nov. 22, 2005

(65) Prior Publication Data

US 2007/0113767 A1 May 24, 2007

(51) Int. Cl.

| | |
|---|---|
| ***D05B 35/02*** | (2006.01) |
| ***B32B 7/08*** | (2006.01) |
| ***B32B 7/12*** | (2006.01) |
| *B32B 7/00* | (2006.01) |

(52) U.S. Cl. ..... 112/475.06; 112/141; 156/93

(58) Field of Classification Search ..... 112/475.06, 112/141, 142, 143, 147, 153, 475.21, 475.26, 112/425, 423, 475.08, 441; 156/91, 92, 93
See application file for complete search history.

(56) References Cited

U.S. PATENT DOCUMENTS

| | | | | |
|---|---|---|---|---|
| 682,283 | A * | 9/1901 | Schneider | 112/425 |
| 1,496,672 | A * | 6/1924 | Habbert | 112/423 |
| 3,690,277 | A * | 9/1972 | Baxter et al. | 112/475.24 |
| 4,312,285 | A * | 1/1982 | Ketterer | 112/475.24 |
| 4,372,998 | A * | 2/1983 | Shimada | 428/193 |
| 5,050,514 | A * | 9/1991 | Niederkorn | 112/235 |
| 5,775,394 | A * | 7/1998 | Wong | 112/441 |
| 6,308,648 | B1 * | 10/2001 | Burton et al. | 112/475.08 |

FOREIGN PATENT DOCUMENTS

JP 60088173 A * 5/1985

* cited by examiner

*Primary Examiner*—Ismael Izaguirre
(74) *Attorney, Agent, or Firm*—Darby & Darby

(57) ABSTRACT

A method for forming a textile article includes forming a hem. An end flap at the edge of the article is folded toward the main body of the textile article. An inner end of the flap is held to the main body of the textile article. The method for holding the article may be by thermal bonding of the flap to the main body or application of an adhesive therebetween. Embellished stitching secures the hem to the main body of the textile article.

3 Claims, 3 Drawing Sheets

METHOD OF PRODUCING FUNCTIONAL EMBELLISHED STITCHING AND THE PRODUCT THEREOF

FIELD OF THE INVENTION

The invention generally relates to home textiles and specifically relates to a method of hemming home textiles with an attractive functional stitch.

BACKGROUND OF THE INVENTION

Textile articles, such as linens and clothing, are typically made of one or more pieces cut from a large roll fabric. At the edge of the fabric pieces the fibers contained therein have loose ends where they have been cut. The loose ends result in an edge which is unattractive if left unfinished. Furthermore, an unfinished edge may begin to fray, is easily torn or can result in the fabric unraveling. The most common method of finishing the fabric piece is to hem the edges, such that the cut edge is folded over twice and the resulting three layers of fabric are sewn together. This results in the cut edge being entirely enclosed in between the folded fabric, such that it is not visible and may not fray.

A hem requires only the simplest stitching of thread to hold the fabric together. However, a simple hemstitch is plain and it is frequently desirable to have a more attractive hem. To enhance the hem, a more elegant and embellished stitch may be used. Alternatively, decorative elements may be sewn to cover the hemstitch.

A conventional method of hemming a textile article with an embellished stitch is shown in FIGS. 1*a* through 1*e*. The cut edge 12 of textile article 10 is folded over a first time producing fold edge 14, such that cut edge 12 is adjacent an interior region of the fabric and parallel to fold edge 14. The article 10 is subsequently folded over a second time in the same manner, producing finished edge 16 which is parallel to both cut edge 12 and fold edge 14. As a result, cut edge 12 is completely enclosed within the fabric. Typically, the distance between cut edge 12 and fold edge 14 is the same or smaller than the distance between fold edge 14 and finished edge 16. This assures that the folded fabric lays flat and is not bunched within the hem.

After the first and second folds, the layers of fabric are fixed in place by fix stitching 18 along fold edge 14. The folded fabric and fix stitching 18 is shown in FIG. 1*b*. Embellished stitching 20 is then added to textile article 10 covering the plain fix stitching 18.

Imported home textiles are subject to a tariff according to the Harmonized Tariff Schedule of the United States (HTS). The magnitude of the tariff varies with the type of fabric used and elements included in the textile article. Section 6302 of the HTS requires that higher tariffs be paid for textile articles that include certain embellishments. Specifically, section 6302 states that articles containing embroidery, lace, braid, edging, trimming, piping or applique work are subject to higher tariffs than those that do not. For example, plain cotton bed-sheets are subject to a tariff of 6.7%, whereas cotton bed-sheets with one of the listed embellishments are subject to a tariff of 20.9%. Therefore, it is desirable to exclude the use of added decoration in textile articles to avoid the high tariff, and only include stitching. Without the inclusion of added ornamentation, it is desirable to include an embellished stitch so that the textile article is not plain. However, an article as shown in FIG. 1*b* which includes the embellished stitch formed in the manner described above is subject to the higher tariff as including embellishments.

The United States International Trade Commission views the embellished stitching 20 shown in FIG. 1*e* as one of the listed embellishments in light of the fix stitching 18. The fix stitching 18 is viewed as the functional element securing the hem and the embellished stitching 20 around it is viewed as purely ornamental. As a result, foreign textile manufacturers are required to either pay the higher tariff or import textile articles with plain unattractive hemstitching. Therefore, a method of hemming a textile article with attractive stitching, but without fix stitching, is highly desirable.

SUMMARY OF THE INVENTION

The present invention is for a method of producing a textile article including functional attractive stitching. The method is especially useful for producing home textiles and provides an attractive product that is not subject to the high tariffs set forth in section 6302 of the HTS on home textiles with embellishments.

In one embodiment of the invention the method includes the steps of folding a cut edge of a cut piece of textile inward forming a flap and a folded edge. The piece of textile is then folded over a second time enclosing the cut edge within the material. Consequently, the folded edge is disposed toward the body of the textile piece and a new finished edge is formed at the border of the textile piece. The flap is then attached to the body of the textile piece. The attachment may be made by thermal bonding or by an adhesive. An attractive or embellished stitching is then sewn to secure the finished edge to permanently fix the flap to the body of the textile.

Another embodiment of the invention includes the step of folding a cut edge of a piece of textile material inward, forming a flap and a finished edge. The flap is attached to the body of the textile piece either by thermal bonding or an adhesive. The flap is secured to the body of the textile by an attractive or embellished stitching.

The embellished stitching may be formed as a plurality of parallel stitches adjacent one another. The embellished stitching may enclose an inner edge of the textile material, either the folded edge if two folds were made, or the cut edge if only a single fold was made. Alternatively, the stitching may be a decorative design of any of a variety of shapes.

The article formed may be a bed linen, table linen or other textile article.

BRIEF DESCRIPTION OF THE DRAWINGS

These and other objects and features of the invention will become more apparent by referring to the drawings, in which.

DETAILED DESCRIPTION OF THE PREFERRED EMBODIMENTS

Figure 1A:
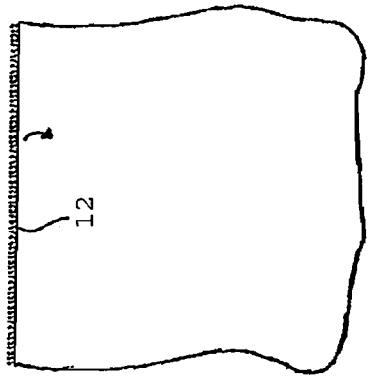
FIG. 1*a* is a front view of a conventional textile material showing a cut edge.
Figure 1B:
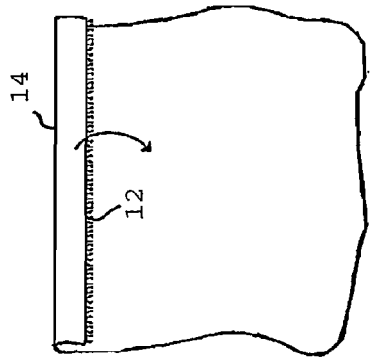
FIG. 1*b* is the material of FIG. 1*a* folded over once during the formation of a hem.
Figure 1C:
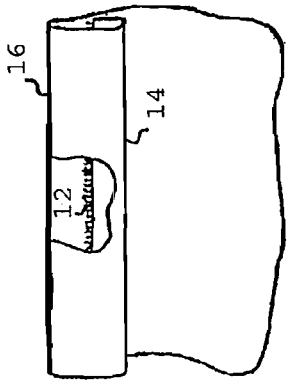
FIG. 1*c* is the material of FIG. 1*b* folded a second time during the formation of a hem.
Figure 1D:
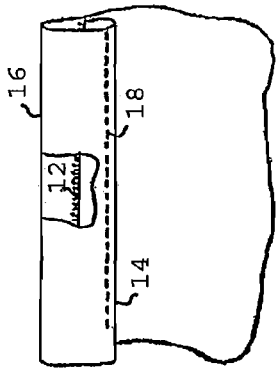
FIG. 1*d* is the material of FIG. 1*c* with stitching to fix the hem in place.
Figure 1E:
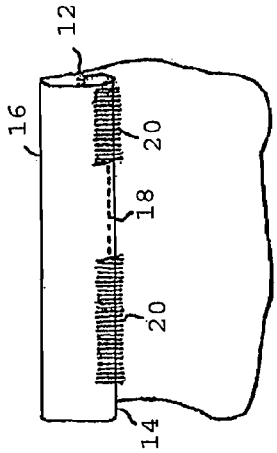
Fig. 1e PRIOR ART
FIG. 1*e* is the textile article of FIG. 1*d* with an attractive stitching.
Figure 2A:
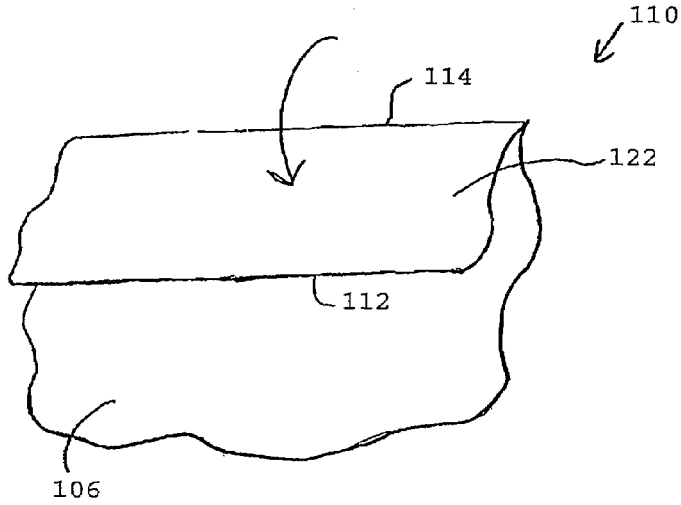
FIG. 2*a* is a front view of a textile article with an edge folded in accordance with the an embodiment of the present invention.
Figure 2B:
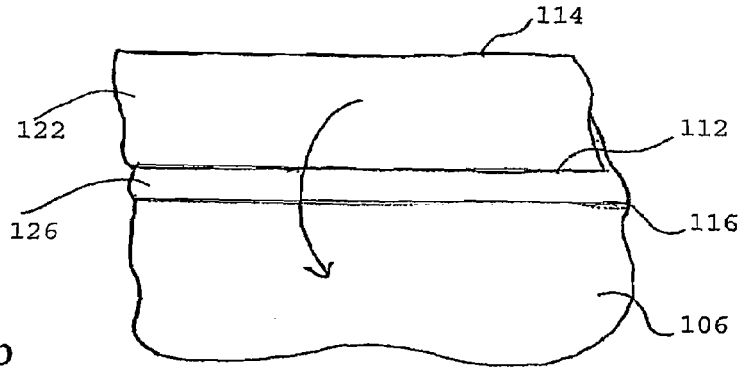
FIG. 2*b* is a front view of the textile article folded a second time in accordance with the present invention.
Figure 2C:
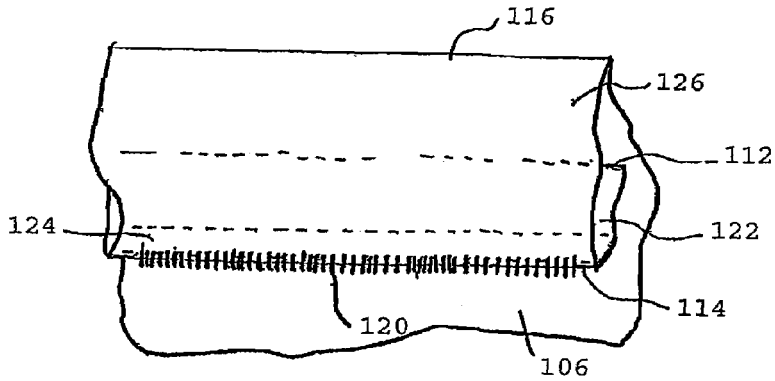
FIG. 2*c* is a front view of the finished article in accordance with an embodiment of the present invention.

One embodiment of the present invention is depicted by FIGS. 2*a*-2*c*. FIG. 2*a* shows a cut piece of textile 110 with cut edge 112. The cut edge 112 is folded inward producing inner flap 122 and fold edge 114, substantially parallel to cut edge 112. The piece of textile 110 is subsequently folded a second time over inner flap 122 forming finished edge 116 and outer flap 126, as shown in FIGS. 2*b* and 2*c*. Finished edge 116 is substantially parallel to fold edge 114. Preferably, outer flap 126 is wider than inner flap 122 so that inner flap 122 is not bunched in between outer flap 126 and the body of the textile material 106.

The folded configuration is then preferably fixed before it is hemmed. To fix the configuration either all or a section of inner flap 122 is attached to the body 106 of the textile material. The attachment may be accomplished using any of a variety of methods. If the textile material is formed of polymer fibers or other materials suitable for thermal bonding 124, a portion of inner flap 122 may be thermally bonded to the body 106 of the textile material. If the textile is formed of natural fibers, which are not suitable for thermal bonding (such as cotton) a thermal bonding agent may be added to attach inner flap 122 to the textile body 106. Thermal bonding 124 uses the thermoplastic properties of synthetic fibers. The layers of textile and any required bonding agent are heated until the synthetic fibers (either contained in the agent or in the textile itself) reach the melting point. Upon cooling strong bonds are created between the fibers. Besides thermal bonding, the attachment may be made using an adhesive 124. The adhesive 124 is disposed between inner flap 122 and textile body 106 to hold them together.

As shown in FIG. 2*c*, embellished stitching 120 is added to complete the hem and secure the finished textile edge. To secure the textile edge, stitching 120 may pass through the textile body and at least one of inner flap 122 and outer flap 126. The textile article shown in FIG. 2*c* includes merrow stitching that surrounds fold edge 114. Stitching 120 is shown as a merrow stitch or satin stitch, which has each stitch abutting the adjacent stitches. Each stitch (a) passes through only textile body 106 on one side and (b) passes through textile body 106, inner flap 122 and outer flap 126 on the other side. The stitch may pass through the attached portions of inner flap 122 and textile body 106. Alternatively, the attached portions may be contained entirely inside embellished stitching 120 close to fold edge 114 or it may be entirely outside embellished stitching 120 close to cut edge 112.

Figure 3A:
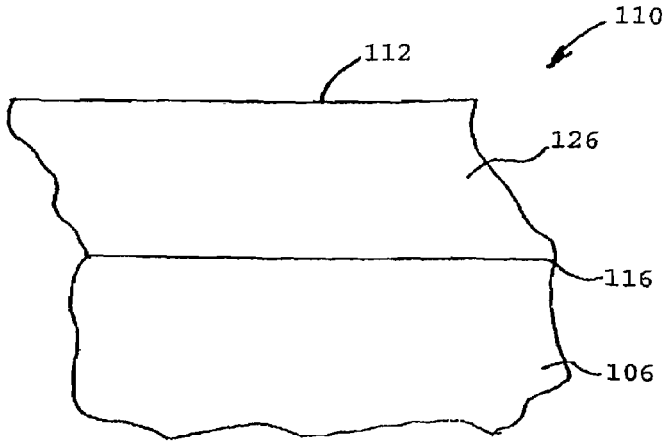
FIG. 3*a* is a front view of a textile article with an edge folded in accordance with another embodiment of the present invention.
Figure 3B:
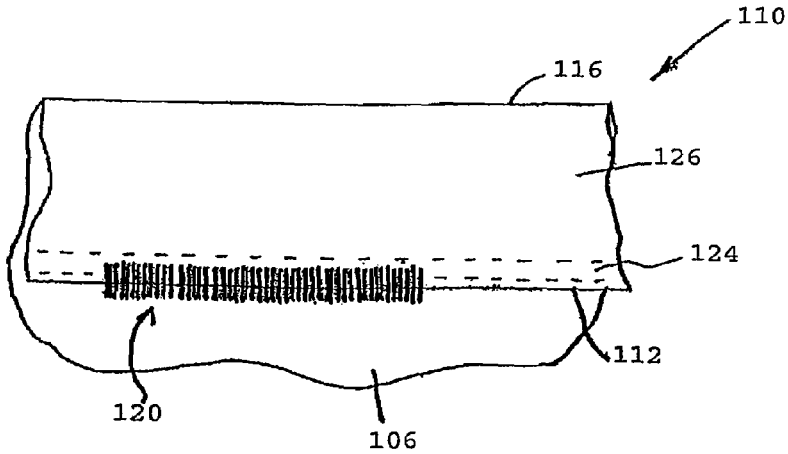
FIG. 3*b* is a front view of the finished article of FIG. 3*a* in accordance with another embodiment of the present invention.

Another embodiment of the present invention is shown in FIGS. 3*a* and 3*b*. A cut piece of textile 110 with cut edge 112 is folded over to form outer flap 126 and finished edge 116. Finished edge 116 and cut edge 112 may be made to be substantially parallel. At least a portion of outer flap 126 is held against the textile body 106, for example physically by one of the above-mentioned methods. Embellished stitching 120 is subsequently stitched in cut textile piece 110 to secure the hemmed finished edge 116.

While thermal bonding 124 or an adhesive may be used to hold the hem in any of the embodiments shown, it is also possible to physically hold the hem together without these aids. This increases the possibility that the elements of the hem may move during sewing, but it eliminates one step in the process, thus saving time, and it also eliminates the need for thermal bonding equipment or adhesive application equipment, thus saving in costs.

The textile articles shown in FIGS. 2*c* and 3*b* include embellished stitching that is a series of parallel stitches, like a satin stitch, which completely surrounds the inner end of the hem, namely fold edge 114 and cut edge 112 respectively. However, the attractive or embellished stitching may take on a variety of designs.

Many of the features of the textile article may be varied, as will readily be apparent to those skilled in this art, without departing from the scope of the method of the invention. Thus, the foregoing description is illustrative and not limiting. It is the intention, therefore, to be limited only as indicated by the scope of the claims appended hereto.

We claim:

1. A textile article comprising:

a main body;

a hem in the form of a flap having an inner surface, an outer surface, an inner cut edge, and an outer folded edge joining the flap and the main body;

a thermally bonded portion between the main body and the flap; and a satin stitch securing the flap to the main body, said stitch passing through at least one of the thermally bonded portion and a portion adjacent the thermally bonded portion, wherein the satin stitch at least partially encloses the inner cut edge.

2. A textile article comprising:

a main body;

a hem in the form of a flap having an inner surface, an outer surface, an inner cut edge, and an outer folded edge joining the flap and the main body;

an adhesive between the main body and the flap; and a satin stitch securing the flap to the main body, said stitch passing through at least one of the adhesive and a portion adjacent the adhesive, wherein the satin stitch at least partially encloses the inner cut edge.

3. A method of hemming a textile article, the method comprising the steps of:

folding the article to form a main body and a hem including a flap, the flap having a fold edge and an inner cut edge;

holding the hem to a surface of the main body using one of thermal bonding and adhesive; and applying a satin stitching to the article thereby securing the flap of the hem to the main body and at least partially enclosing the inner cut edge of the flap inside the satin stitching.

* * * * *